US009181783B2

(12) United States Patent
Gabdullin

(10) Patent No.: US 9,181,783 B2
(45) Date of Patent: Nov. 10, 2015

(54) WELL-DRILLING SUCKER-ROD PUMP

(76) Inventor: Rivener Musavirovich Gabdullin, Moscow (RU)

( * ) Notice: Subject to any disclaimer, the term of this patent is extended or adjusted under 35 U.S.C. 154(b) by 211 days.

(21) Appl. No.: 13/876,490

(22) PCT Filed: Sep. 12, 2011

(86) PCT No.: PCT/RU2011/000697

§ 371 (c)(1),
(2), (4) Date: Jul. 6, 2013

(87) PCT Pub. No.: WO2012/044200

PCT Pub. Date: Apr. 5, 2012

(65) Prior Publication Data

US 2013/0302193 A1 Nov. 14, 2013

(30) Foreign Application Priority Data

Sep. 29, 2010 (RU) ..... 2010139960

(51) Int. Cl.

| | |
|---|---|
| ***E21B 34/08*** | (2006.01) |
| ***E21B 43/12*** | (2006.01) |
| ***F04B 47/02*** | (2006.01) |
| ***F04B 53/10*** | (2006.01) |

(52) U.S. Cl.

CPC ..... *E21B 43/127* (2013.01); *E21B 34/08* (2013.01); *F04B 47/02* (2013.01); *F04B 53/10* (2013.01)

(58) Field of Classification Search

CPC ..... E21B 43/127; E21B 34/06; E21B 34/08; F04B 53/10; F04B 47/02; F16K 15/04; F16K 15/048

USPC ..... 417/434, 435, 554, 440; 166/145, 369

See application file for complete search history.

(56) References Cited

U.S. PATENT DOCUMENTS

| | | | | |
|---|---|---|---|---|
| 5,135,366 | A * | 8/1992 | Ribeiro | 417/435 |
| 5,507,327 | A * | 4/1996 | Ziegler | 141/199 |
| 7,610,930 | B2 * | 11/2009 | Weaver et al. | 137/533.11 |

FOREIGN PATENT DOCUMENTS

| | | | |
|---|---|---|---|
| CN | 2009 96374 | Y | 12/2007 |
| RU | 2317443 | C1 * | 2/2008 |
| SU | 983310 | A1 | 12/1982 |
| SU | 1323743 | A2 | 7/1987 |

OTHER PUBLICATIONS

International Search Report, Dec. 29, 2011, from International Phase of the instant application.

English Translation of the Written Opinion of the International Search Authority, Mar. 29, 2013, from International Phase of the instant application.

* cited by examiner

*Primary Examiner* — Devon Kramer
*Assistant Examiner* — Nathan Zollinger
(74) *Attorney, Agent, or Firm* — Jackson Patent Law Office

(57) ABSTRACT

A well-drilling sucker-rod pump for extracting oil with a large content of gas in the liquid being pumped out. The sucker-rod pump possesses a cylinder containing a hollow plunger, in the lower part of which a delivery valve is mounted. An inlet valve is mounted in the lower part of a pump chamber. The pump is equipped with a passageway having a floating valve which has a floating element and a seat. The cylinder is stepped on the internal surface side, and the passageway having the floating element is formed in the lower part of a smaller cylinder step above the pump chamber. One passageway opening is connected to the upper part of the pump chamber and the other passageway opening is connected to the well. As a result, the pump efficiency is increased and gas generation in the pump chamber is reduced.

7 Claims, 4 Drawing Sheets

WELL-DRILLING SUCKER-ROD PUMP

The present invention refers to the field of oil production and can be used for producing oil from wells in conditions of a high gas content in a pumped out fluid.

Known is a deep-well pumping unit for gas-cut fluid production from wells with solids present in a pumped out fluid which comprises both a cylinder with a main suction valve installed endwise the cylinder, and a supplementary suction valve installed over the main one eccentrically to the cylinder axis, the cylinder containing a receiving chamber at the upper part of which there is a connecting tube coaxial to the supplementary suction valve positioned at the exit of the tube.

A disadvantage of the above unit is low efficiency of the pump due to the unnecessary plunger stroke caused by the presence of free gas.

With respect to the technical essence and resulting effect most similar to this invention is an oil-well sucker-rod pump which comprises a cylinder having a hollow plunger inside with a bypass to the hollow rod string and a float valve installed in the plunger hole equipped with an enveloping sliding piston which has a through-passage hole located so as to be overlapped by the sliding piston.

The drawback of the above pump taken as the prototype is that the float valve, sliding piston and bypass are installed in the flexible plunger of limited diameter sizes, which results in more sophisticated design, lower reliability and higher price of the pump. Moreover, the pump uses expensive and unreliable hollow rods and extra flow resistance reduces its efficiency.

Besides, there is still a problem of the floating ball separation from the seat owing to a high pressure drop in the valve.

The objective of the invention is to increase pump operation efficiency and reduce a gas negative effect on the pump operation.

The technical effect achieved includes a pump efficiency increase and gas generation reduction in the pump chamber.

The stated objective is realized and the technical effect is achieved due to the fact that the sucker-rod pump comprises a cylinder with the hollow plunger inside at the bottom of which there is an injection valve, and a pump chamber with a suction valve at the bottom, moreover, the pump has a bypass with a float valve having a shut-off floating element and a seat above it, the cylinder is made stepped from its inner surface, the bypass with its shut-off floating element is positioned at the cylinder low step bottom above the pump chamber, one chamber hole being connected with the upper pump chamber while the other chamber hole being connected with the well bore.

Furthermore, the shut-off floating element is made hollow. The hollow shut-off floating element is gas filled under the designed pressure. To achieve a seating accuracy the hollow shut-off floating element is in the guide case. The shut-off floating element has a fairing at the pump chamber side, with a drainage hole being inside it.

The axes of the plunger and pump body can be arranged asymmetrically. The bypass with the float valve is an independent unit which can be reinstalled, say, using a threaded connection.

Figure 3:
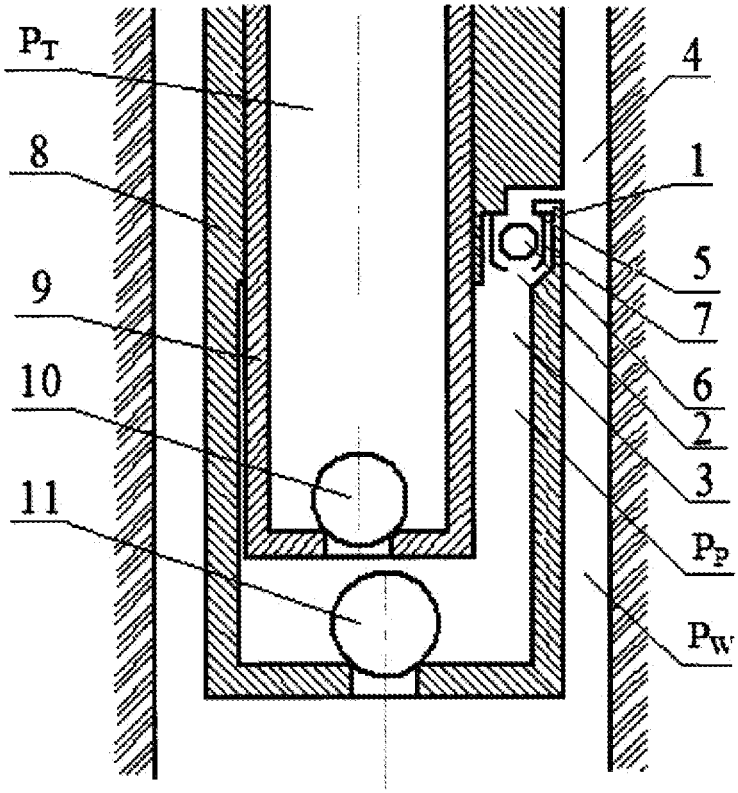
FIG. 3 shows the pump with the plunger and body axes positioned asymmetrically.
Figure 4:
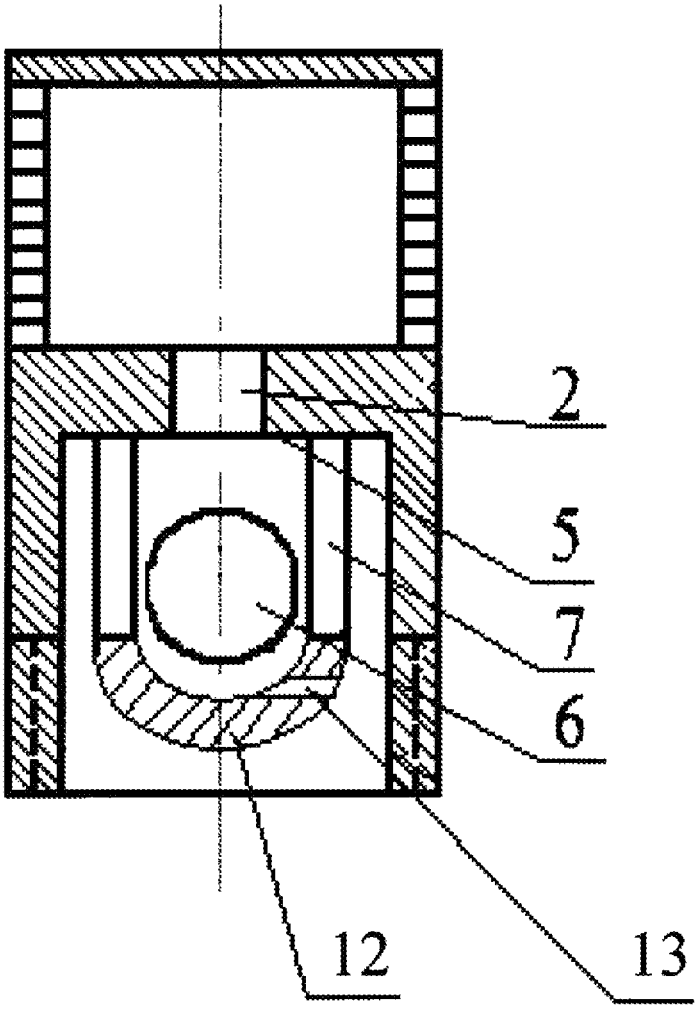
FIG. 4 shows the bypass with the float valve being an independent element.

There is the bypass 2 connecting the upper pump chamber 3 with the wellbore 4 in the fixed part of the pump 1, namely, in the bottom of the lowest step of the stepped inner surface cylinder. The bypass 2 contains the float valve consisting of the seat 5 positioned above, and the shut-off floating element 6, such as a hollow and gas pressure filled ball located in the guide case 7 with positive buoyancy in the borehole fluid. The pump cylinder 8 has the hollow plunger 9 inserted which is able to perform a reciprocating motion relative to the inner wall of the lowest cylinder step 8 and sealed relative to it. The bottom of the hollow plunger 9 contains the injection valve 10, while in the bottom of the pump chamber 3 formed by the highest cylinder step 8 there is the sucking valve 11. At the end of the guide case 7 at the side of the pump chamber 3 the fairing 12 is placed with the drainage hole 13 (FIG. 4) to prevent the float valve from shutting by the flow of gas when withdrawing it from the pump chamber 3. Centralizers (not shown) can be installed at the upper and lower hollow plunger ends. In case of a high solid content in the pumped out fluid one can install a filter (not shown) before the floating valve. The hollow plunger 9 and cylinder 8 is possible to manufacture with an asymmetric axes arrangement. In this case a wide space is formed to place the bypass 2 and the float valve in the pump (FIG. 3). One can design the overflow channel 2 with the float valve as an independent element envisaging its possible installation or reinstallation using a thread connection as an option (FIG. 4). In view of the above, it is possible to have the bypass with the float valve in different sizes, and if required, the seat of the bypass with the float valve can be capped with the thread plug, for instance.

Figure 1:
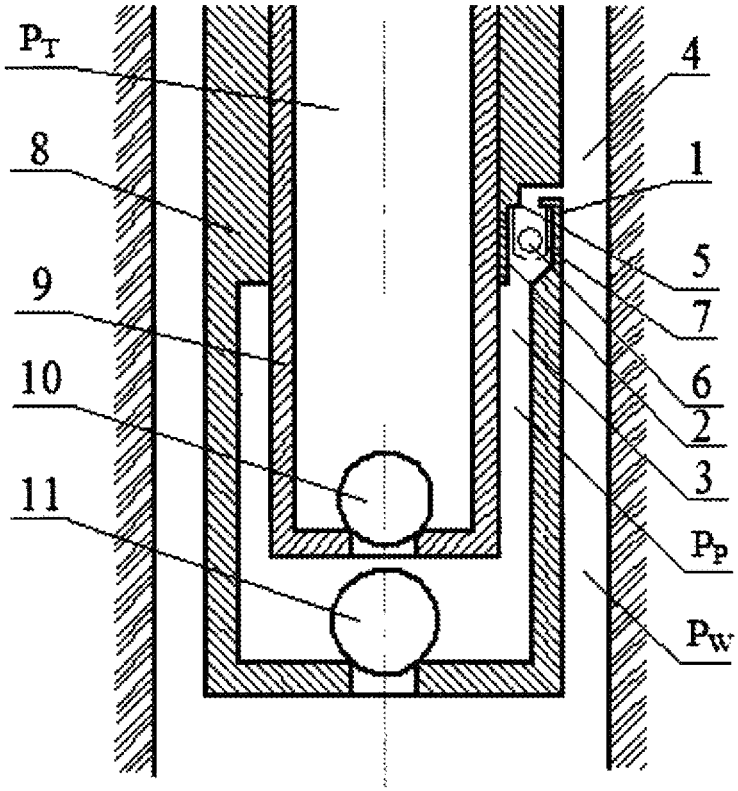
FIG. 1 shows the downhole plunger pump arrangement with the lowermost plunger position.
Figure 2:
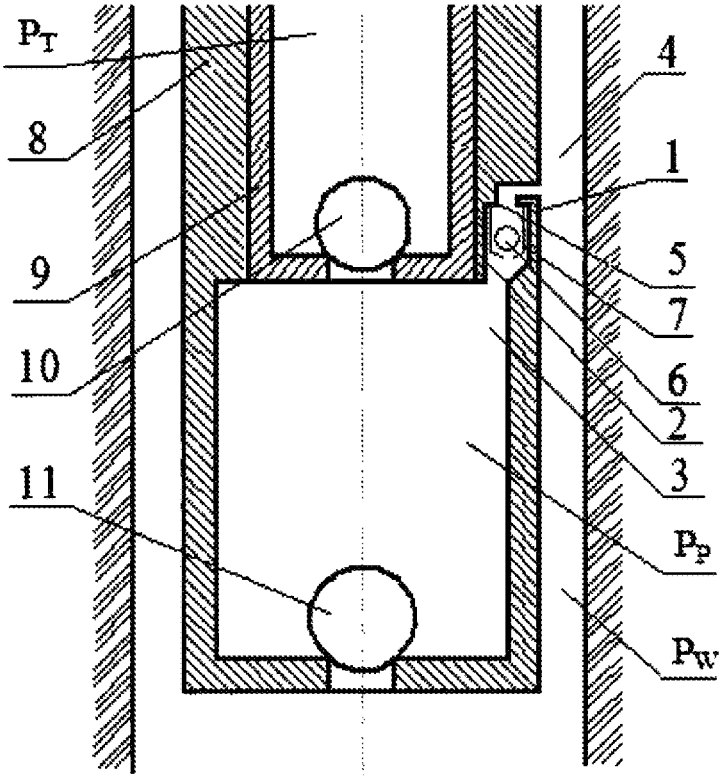
FIG. 2 shows the same but with the uppermost plunger position.

The oil-well sucker-rod pump operates as follows:

At the suction start (FIG. 1) when the plunger 9 moves upward the pump chamber 3 expands and pressure drops, and when the pumped out fluid pressure in the well 4 at the seating level of the float and suction valves exceeds the pressure in the pump chamber 3, the suction valve 11 and shut-off floating element 6 will open and let the pumped out fluid from the well 4 enter the pump chamber 3. At this moment the work chamber pressure ($P_p$) is less than that in the pump-casing annulus ($P_w$) and less than that ($P_T$) inside the hollow plunger 9. When generating free gas in the pump chamber 3 with the shut-off floating element 6 opened there occurs free gas displacement with the pumped out downhole fluid arriving through the bypass 2 and/or partial gas dissolution in the pumped out downhole fluid arriving through the float and suction valves ($P_p<P_w$ and $P_p<P_T$). If there is still some free gas in the pump chamber 3 when the injection process is about to start, the float valve remains open since the gas fails to uplift the shut-off floating element 6. At the beginning of the pressing out process (FIG. 2) when the hollow plunger 9 starts moving downward, the suction valve 11 closes while the injection valve 10 is not yet opened, the shut-off floating element remains open thus making it possible for the pumped-out fluid to keep on entering the pump chamber 3 until the pressure in the pump chamber 3 equals that in the borehole 4 ($P_p=P_w$ and $P_p<P_T$). Nevertheless, bubbling of the gas from the pump chamber 3 through the bypass 2 into the well can not be excluded. Once the pressure ($P_p$) in the pump chamber 3 exceeds the borehole pressure ($P_w$) there starts the pressing out of non-dissolved gas into the well 4 through the bypass valve ($P_w<P_p$ and $P_p<P_T$). With the outcome of free gas from the pump chamber 3 the level of the pumped-out fluid increases, the fluid enters the bypass 2 and starts uplifting of the shut-off element floating in it along the guide case 7 to its subsequent landing on the seat 5, The increased pressure in the pump chamber 3 presses the shut-off floating element 6 to the seat 5 and closes the floating valve leakproof. When the plunger 9 moves further downward the increased pressure in the pump chamber 3 having reached the fluid pressure in the string (not shown) opens the injection valve 10 and the fluid from the pump chamber 3 arrives from the open injection valve 10 into the plunger cavity 9 and further on into the string ($P_w<P_p$ and $P_p=P_T$). Reaching its lowermost position the plunger 9 changes its motion vector for the counter one and the process recycles.

Thus, the float valve equipped pump which is offered here performs three major stages to reduce a negative effect of the gas-oil ratio.

1-st stage. Reduction in gas generation. In sucking the pumped-out fluid from the well into the pump chamber the float valve reduces gas pond by the delivery of the pumped-out fluid into the upper pump chamber, i.e. into the area of gas pond, since in this case the float valve acts as a supplementary suction valve.

2-nd stage. Fluid gas displacement. In pressing out the pumped-out fluid from the pump chamber into the lifting string at the initial pressing out stage the opened float valve keeps on operating as a supplementary suction valve providing an access of the pumped-out fluid from the well into the pump chamber until the pump chamber pressure and that in the well become equal.

3-rd stage. Gas outlet into the well. In keeping on to press out the pumped-out fluid from the pump chamber into the lifting string after the pump chamber pressure exceeds the borehole pressure a complete volume of free gas is pressed out through the opened float valve till its closure by the pumped out fluid.

In all stages free gas can be withdrawn from the pump chamber into the well through the bypass float valve.

The above said allows a suction period increase within the pump operation cycle. The pump offered here has its float valve installed independently rather than in the pumped out fluid flow, thus creating no extra flow resistance forces for the pumped out fluid.

The service advantage of the invention lies in the possible application of the pump float valve for some other pumps of different types and sizes where there occurs a free gas problem in gas-liquid pumping. The float valve of the pump offered can be manufactured as an independent unit and mounted, say, using a thread connection, into the upper point of the pump gas pond.

What is claimed is:

1. A sucker-rod pump for deployment in a well liquid in a well bore comprising:

a pump chamber;

a cylinder;

a reciprocating hollow plunger inside the cylinder, the plunger defining a bottom;

an injection valve at the bottom of the plunger, the injection valve being configured to interact with the pump chamber;

a suction valve at the bottom of the pump chamber;

a bypass defining a first hole being connected with the pump chamber and a second hole configured to be connected with the well bore; and a check valve in the bypass, the check valve including a valve member having positive buoyancy in the well liquid, and a seat between the valve member and the second hole, the valve member being configured to come into, and out of, contact with the seat, wherein the cylinder defines a first inner diameter in a cylinder part above the bypass, and a second inner diameter in a cylinder part below the bypass, the second inner diameter being larger than the first inner diameter.

2. The sucker-rod pump according to claim 1, wherein the reciprocating hollow plunger defines an axis arranged asymmetrically with the second inner diameter of the cylinder.

3. A sucker-rod pump according to claim 1 wherein the valve member is hollow.

4. A sucker-rod pump according to claim 1 wherein the valve member is gas filled under the designed pressure.

5. A sucker-rod pump according to claim 1 further including a guide case in the bypass, wherein the valve member is in the guide case.

6. A sucker-rod pump according to claim 1 wherein the check valve is an independent unit that can be reinstalled using a threaded connection.

7. A sucker-rod pump according to claim 1 further including a fairing between the valve member and the pump chamber, the fairing defining a drainage hole.

* * * * *